US007546922B2

(12) United States Patent
Howard

(10) Patent No.: US 7,546,922 B2
(45) Date of Patent: Jun. 16, 2009

(54) ARTICLE TRANSPORT AND STORAGE DEVICE

(75) Inventor: Randy Louis Howard, Frankfort, KY (US)

(73) Assignee: Foam Design Inc., Lexington, KY (US)

( * ) Notice: Subject to any disclaimer, the term of this patent is extended or adjusted under 35 U.S.C. 154(b) by 571 days.

(21) Appl. No.: 11/306,823

(22) Filed: Jan. 12, 2006

(65) Prior Publication Data

US 2007/0158282 A1 Jul. 12, 2007

(51) Int. Cl.
*B65D 85/00* (2006.01)

(52) U.S. Cl. ..... 206/445; 206/303; 206/335; 206/499; 206/587; 211/23; 211/59.4; 312/319.4; 312/327

(58) Field of Classification Search ..... 206/303, 206/335, 445, 499, 587; 211/23, 59.4, 150; 312/319.4, 327

See application file for complete search history.

(56) References Cited

U.S. PATENT DOCUMENTS 3,559,866 A 2/1971 Olson
5,324,105 A * 6/1994 Christensen ..... 312/319.4
5,339,958 A * 8/1994 Taravella et al. ..... 206/521
5,509,534 A * 4/1996 Taravella et al. ..... 206/587
5,887,718 A 3/1999 Oslin
6,394,721 B1 5/2002 Campbell
6,877,605 B2 4/2005 Tsai

* cited by examiner

*Primary Examiner*—Bryon P Gehman
(74) *Attorney, Agent, or Firm*—Stoll Keenon Ogden PLLC; James M. Francis; Justin M. Tromp

(57) ABSTRACT

An apparatus for storing articles comprises a plurality of individual article support devices for supporting a plurality of articles independent of the side walls of a container. Each article support device comprises a first rack and a second rack. Each one of the racks comprises a first spine and a second spine, each spine having notches for receiving the peripheral surface of the articles. Each rack also has a plurality of openings formed in each rack disposed intermediately to each spine. At least one of the racks has a coupling mechanism for coupling the first spine and the second spine to form one of the racks for coupling to the other rack through one of the openings. The racks are coupled so that the spines of one of the racks are oriented approximately ninety degrees to the adjacent spines of the other rack.

27 Claims, 9 Drawing Sheets

ARTICLE TRANSPORT AND STORAGE DEVICE

RELATED U.S. APPLICATION DATA

Not applicable.

FIELD OF THE INVENTION

The present invention relates, in general, to a transport and storage apparatus and, more specifically, to apparatus for storing and transporting annular objects, such as vehicle steering wheels, wherein said apparatus minimizes dead space between stored objects by nesting one stored row of objects within the dead space of another.

BACKGROUND OF THE INVENTION

Objects such as automotive parts are routinely transported in commerce from supplier to manufacturer or distributor. In order to minimize costs and reduce overhead it is desirable to transport as many objects as possible within a confined space such as a trailer or railcar. Additional benefits include fuel savings and related reduction in pollution from the ability to transport an increased number of objects per given volume of fuel consumed.

One apparatus utilized as a steering wheel storage rack stacks the steering wheels on vertical spindles which pass through the center orifice of the wheel, resulting in the storage of the wheels in parallel horizontal planes. The advent of the air bag assembly incorporated into the center of the steering wheel has made this method of storage obsolete.

Yet another storage rack employs a metal frame with a plurality of vertically arranged, pivotal shelves. Each shelf supports two pairs of spaced, article support members formed of molded urethane foam or E.V.A. with spaced notches sized to receive a peripheral portion of each steering wheel. The notches are offset in two article support members to nest each steering wheel in each row vertically between portions of steering wheels in adjacent top and bottom rows.

Another steering wheel rack utilizes a square wood stud with four notched racks of cellular polyethylene mounted by means of adhesive on the four sides of the stud. The ends of the racks are mounted in supports attached to the inner sides of a container in a vertically and horizontally spaced matrix arrangement of rows and layers. The notches in the racks are offset from end to end to nest the steering wheels in horizontal rows.

A two-piece plastic dunnage is disclosed, in U.S. Pat. No. 5,509,534, for use within containers for shipping or storing items in a preselected arrangement within a container. The preferred embodiment of the two-piece dunnage designed in accordance with this invention includes an essentially flat base member and a generally U-shaped support member that is slidably and removably coupled with the base member in a supporting position. The support member may be provided with a plurality of transverse slots which are adapted to nestingly receive at least a portion of the items that are to be maintained within the container in the preselected arrangement.

U.S. Pat. No. 3,559,866 describes a carton liner fabricated from a paperboard strip deformed so that triangular projections of two different sizes extend inwardly from the interior wall of a carton. The larger triangular sections include slots formed centrally within each apex edge for accommodating a platelike article having its edges disposed within the aligned slots. The smaller triangular projections provide lateral support for the article retained within the slots.

Yet another article transport and storage device, as disclosed in U.S. Pat. No. 5,887,718 (issued to Oslin et al.), utilizes a article support means for supporting the peripheral surfaces of a plurality of articles. The article support means includes a tubular member having at least a two side surfaces. Preferably the tubular member is a hollow, extrusion. A rack carries the plurality of notches. Mounting means are provided for mounting each rack to one of the side surfaces of the tubular member. In a preferred embodiment, the mounting means comprises inward extending flanges formed on the side surfaces of the tubular member and defining an open ended slot which receive side slots formed on the bottom of each rack. The racks are arranged in a reversed 180 degree orientation with respect to each other on two side surfaces of the tubular member. In particular, a plurality of article support means are utilized within a container so that the articles may be contained and shipped in a nested manner, in which the articles are arranged in horizontal and vertical rows and are nested in two dimensions, i.e., horizontally and vertically, to increase the number of articles which can be stored in a single container.

More specifically, and with reference to U.S. Pat. No. 5,887,718, and as depicted in FIGS. 1-4 in the present application, labeled as PRIOR ART, there is depicted one embodiment of an article transport and storage apparatus 10 which is devised for storing and transporting articles in a container 12. The article support apparatus 10 of the present invention is devised to be mounted in a container 12. Any container having any dimensions may be employed with the article transport apparatus 10 of the present invention. However, it is preferred that the container 12 be one having pivotal sides, such as a container sold under the trademark Ropak. As is known, such a container has pivotal sides which are hinged approximately ⅓ up from the bottom of the container. Latches are provided on the hinged portions of the side walls of the container to enable the side walls to be latched in a vertical use position forming a generally square or rectangular interior cavity within the container as well as enabling the hinged side wall portions to be dropped into a general horizontal, overlapped arrangement within the container for storage or transport back to the manufacturing facility wherein the overall height of the container is reduced to less than ½ of its article storage height.

As shown in FIGS. 1-4, the base assembly 14 has a planar bottom wall 20 and a pair of upstanding side walls 22 and 24. The side walls 22 and 24 are formed by folding over opposed end portions of the bottom wall 20 into two, spaced walls which are perpendicularly oriented with respect to the bottom wall 20. A substantially rigid nine pound density polyethylene foam strip 26 is mounted interiorly within each of the pair of spaced walls forming the side walls 22 and 24 for rigidity. Cable ties 28 extend through apertures in each side walls 22 and 24 and the foam strip 26 to secure each side wall 22 and 24 and the intervening foam strip 26 in the desired position with respect to the bottom wall 20.

A plurality of apertures 30 are formed at least partially and, preferably, completely through the wall portions of each side wall 22 and 24 as well as the intermediate foam strip 26. Although any shaped aperture 30 may be employed, in the preferred embodiment, each aperture 30 has a square cross-section disposed in the orientation shown in FIG. 1 for receiving the base article support means 16 and 18 therein, as described hereafter.

The base 14 is formed, by example only, of a plastic corrugated material, such as corrugated polyethylene or polypropylene. Other lightweight materials having the requisite strength may also be employed to form the base 14.

A center support 32 is fixedly mounted, such as by adhesive or screw fasteners, not shown, to the bottom wall 20 of the base 14 generally centrally between the opposed side walls 22 and 24. The central support 32 is preferably formed of a nine pound density polyethylene foam. A plurality of generally V-shaped notches 34 are formed along the length of the center support 32 and are aligned with the apertures 30 in the side walls 22 and 24 for supporting one of the base article support means 16 and 18 therein.

As shown in detail in FIGS. 2 and 3, each base article support means 16 and 18 includes a centrally disposed tubular member 40. Preferably, the tubular member 40 is hollow and has a generally square cross-section formed of four joined side walls 42. A pair of inverted, upstanding, L-shaped flanges 44 project from the corners of the tubular member 40 and form open notches 46 adjacent each wall 42.

As shown in FIGS. 1 and 2, first and second ends 39 and 41 of each article support means 16 and 18 project outwardly from the adjacent ends 52 and 54 of the racks 50B and 50A, respectively. The first and second ends 39 and 41 of each tubular member 40 in each article support means 16 and 18 are inserted into the apertures 30 in the side walls 22 and 24 to enable the article support means 16 and 18 to be supported by the side walls 22 and 24 of the base 14. In the base assembly 14, two of the notches 46 in the tubular member 40 receive a pair of individual racks 50A and 50B.

Due to the different mounting positions of the racks 50A and 50B, relative to one another, on the article support means 16 and 18 and the alternating mounting of the article support means 16 and 18 across one dimension of the base 14, the notches 56A in each pair of article support means 16 and 18 as well as the notches 56B in opposed pairs of article support means 16 and 18 are laterally aligned with like notches 56A or 56B to receive one article, such as the peripheral rim or edge of a steering wheel. Further, each pair of similar, opposed notches 56A and 56B are longitudinally offset along the other dimension of the base 14 to offset and nest two adjacent articles in two adjacent rows.

This offset or staggered arrangement of the steering wheels 66 in the three rows formed by the two pair of article support means 16 and 18 on the base 14. Due to the closer spacing of the notches 56A in the center row to the side wall 22 than the adjacent pair of notches 56B in the two adjacent rows, steering wheel 66 when mounted in notches 56A in the center row on the base 14, will be disposed closer to the side wall 22 of the base 14 than the steering wheels 66 in the two adjacent rows. This nests the peripheral edge or rim 68 of the steering wheel 66 in the center row in a horizontal, overlapped or nested manner with the rims 68 of the laterally adjacent steering wheel 66 in the two outer rows.

Similar to the device disclosed in '718 (Oslin et al.), it would be desirable to provide further improvements to an article storage apparatus, such as storage apparatus devised for storing and transporting steering wheels from a steering wheel manufacturing facility to the installation plant. It would also be desirable to provide such an article storage apparatus which is constructed of a minimal amount number of different components. It would also be desirable to provide such an article storage apparatus which is durable for long term reuse. It would also be desirable to provide such an article storage apparatus in which the article storage racks are formed of a material resistant to dirt while at the same time being compatible with a Class A article surface. As such, the present invention fulfills the objectives above, and also provides a device that is more easily assembled than that disclosed in '718 (Oslin et al.) by utilizing a device that requires no central tubular member as a spine for attachment of the article support means. Thus, the present invention overcomes the deficiencies of the prior art.

SUMMARY OF THE INVENTION

In one embodiment of the present invention, an apparatus for storing a plurality of articles is disclosed as having a peripheral surface in the container having side walls and a base. The apparatus comprises a plurality of individual article support means for supporting a plurality of articles in a plurality of longitudinally extending rows independent of the side walls of a container, wherein each one of the article support means comprises a first rack and a second rack. Each one of the racks comprises a first spine and a second spine, wherein each spine has a plurality of notches for receiving the peripheral surface of a plurality of articles.

In another embodiment, an apparatus for storing a plurality of articles having a peripheral surface in a container having side walls and a base in which the apparatus comprises a plurality of article support means for supporting a plurality of articles, wherein each one of the article support means comprises a first rack and a second rack. Each one of the racks comprises a first spine and a second spine, wherein each spine has a plurality of notches for receiving the peripheral surface of a plurality of articles. The apparatus may further comprise a base having a plurality of article support means coupled thereto, such as coupling the article support means to the base via adhesive or via fastener(s).

In another embodiment, and in an apparatus for storing a plurality of articles having a peripheral surface in the container having side walls and a base, the apparatus comprising a plurality of base article support means attached to the side walls and base for forming a series of base article support means in the bottom of the container, the improvement comprises a plurality of individual article support means for supporting a plurality of articles in a plurality of longitudinally extending rows independent of the side walls of the container, wherein each one of the article support means comprises a first rack and a second rack.

In the embodiments provided above, each rack also has a plurality of openings formed in each one of the racks disposed intermediately to each spine. At least one of the spines of each rack having means for separating the first spine and recoupling said first spine through the openings of the second spine so as to form a single rack. More specifically, the separating and coupling means is a male/female coupling of male and female connectors wherein one side of the coupled spine, the male side, possesses a single appendage or male connector possessing at least one ridge that slopes back towards the spine and terminates abruptly leaving a substantially flat face or creating an acute angle between the ridge and stem of the appendage behind the ridge so as to create a friction fit arrangement. The female side possesses two appendages, or female connector, aligned with each opposing male connector designed to receive a corresponding single appendage from the male side and thereby the female side locks it into place by means of matching ridges between the female connector that interlocks connectors with the ridges of the male connector.

The spines are coupled so that the each is oriented at substantially a 90° angle to the other. The notches in the article support means are offset between two adjacent article support means to nest the articles in one article support means within the articles in two adjacent articles support means. The openings are dimensioned to receive and accommodate coupling means in a friction fit arrangement. Coupling means comprises interlocks connecting male and female appendages.

In yet another embodiment, the article support means attached to the base are perforated through the spines so that tie channels are formed therein. Matching perforations are present in the base itself creating yet another tie channel. One end of a tie is passed through the spines and through the base to be joined to its other end using means known to those skilled in the art. Thus the article support means can be fastened to the base without adhesive and in such a way that facilitates the replacement of damaged article support means attached to the base or base member.

As discussed above, the method and device of the present invention overcomes the disadvantages inherent in prior art methods and devices. In that respect, before explaining at least one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Accordingly, those skilled in the art will appreciate that the conception upon which this invention is based may readily be utilized as a basis for the design of other structures, methods, and systems for carrying out the several purposes of the present invention. It is important, therefore, that the claims be regarded as including such equivalent constructions insofar as they do not depart from the spirit of the present invention.

Furthermore, the purpose of the foregoing Abstract is to enable the U.S. patent and Trademark Office and the public generally, and especially including the practitioners in the art who are not familiar with patent or legal terms or phraseology, to determine quickly from a cursory inspection, the nature and essence of the technical disclosure of the application. The Abstract is neither intended to define the invention of the application, nor is it intended to be limiting to the scope of the invention in any way.

BRIEF DESCRIPTION OF THE DRAWINGS

Additional utility and features of the invention will become more fully apparent to those skilled in the art by reference to the following drawings, which illustrate the primary features of the preferred embodiment and numerous alternative embodiments.

DETAILED DESCRIPTION OF THE PREFERRED EMBODIMENT

Figure 1:
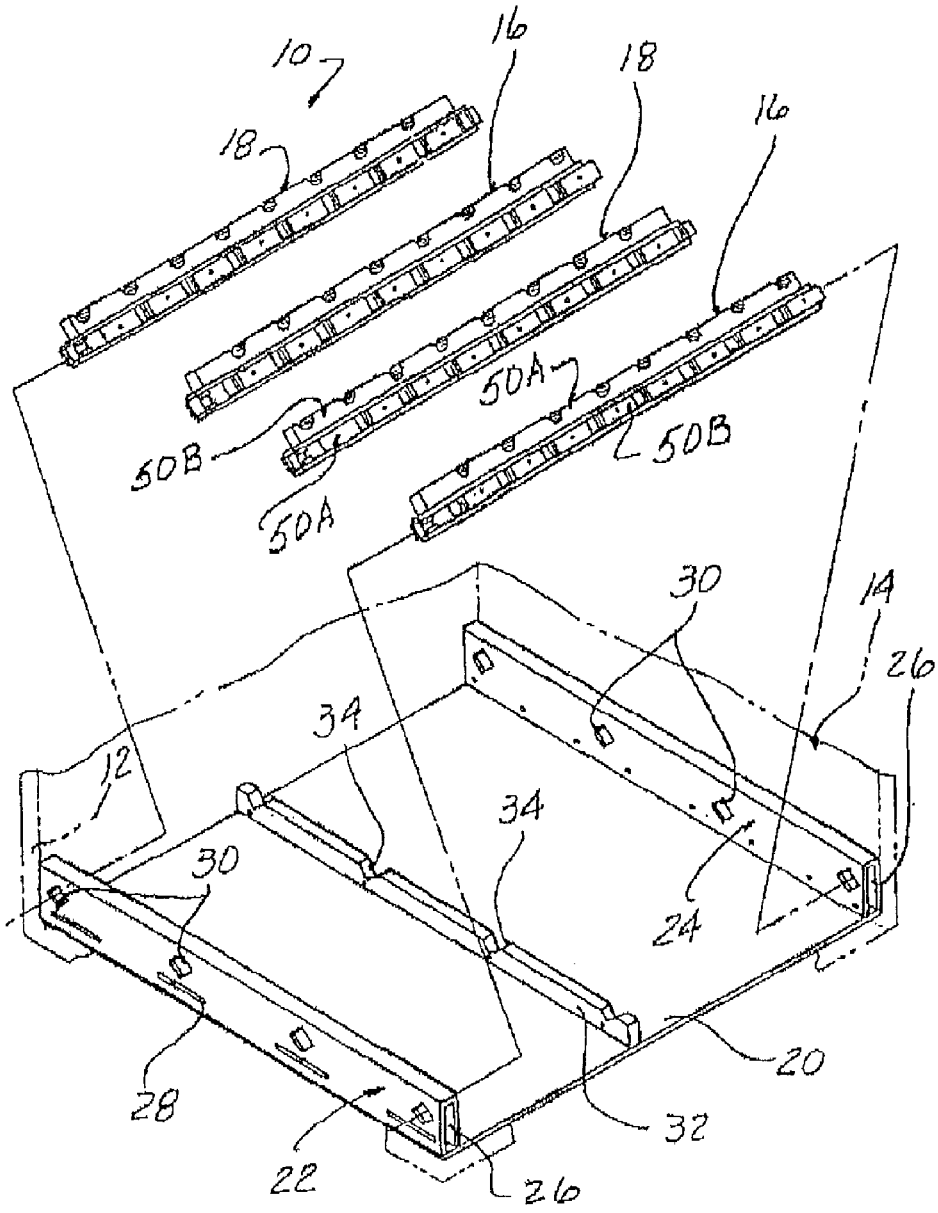
Fig. 1 (Prior Art)
FIG. 1 is an exploded, perspective view of the base assembly of the article transport and storage apparatus of the known PRIOR ART.
Figures 2, 3:
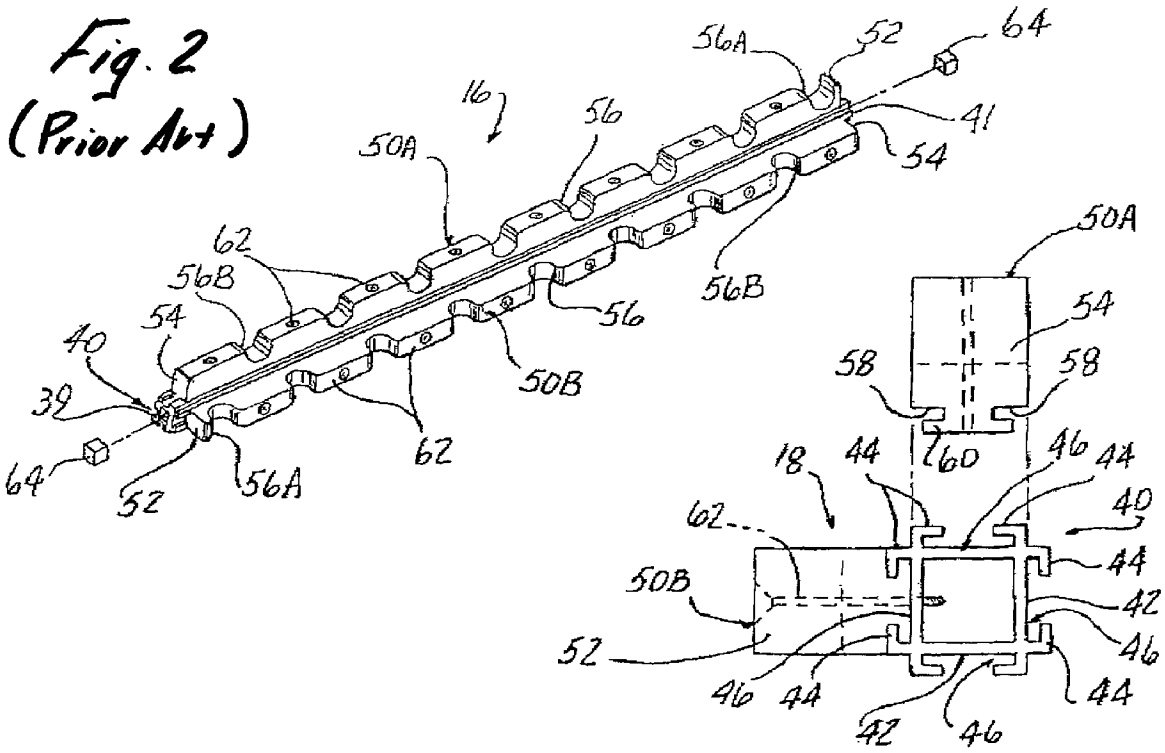
Fig. 2 (Prior Art)
Fig. 3 (Prior Art)
FIG. 2 is a perspective view of one of the base article support means of the PRIOR ART.
FIG. 3 is an end view of another base article support means of the PRIOR ART.
Figure 4:
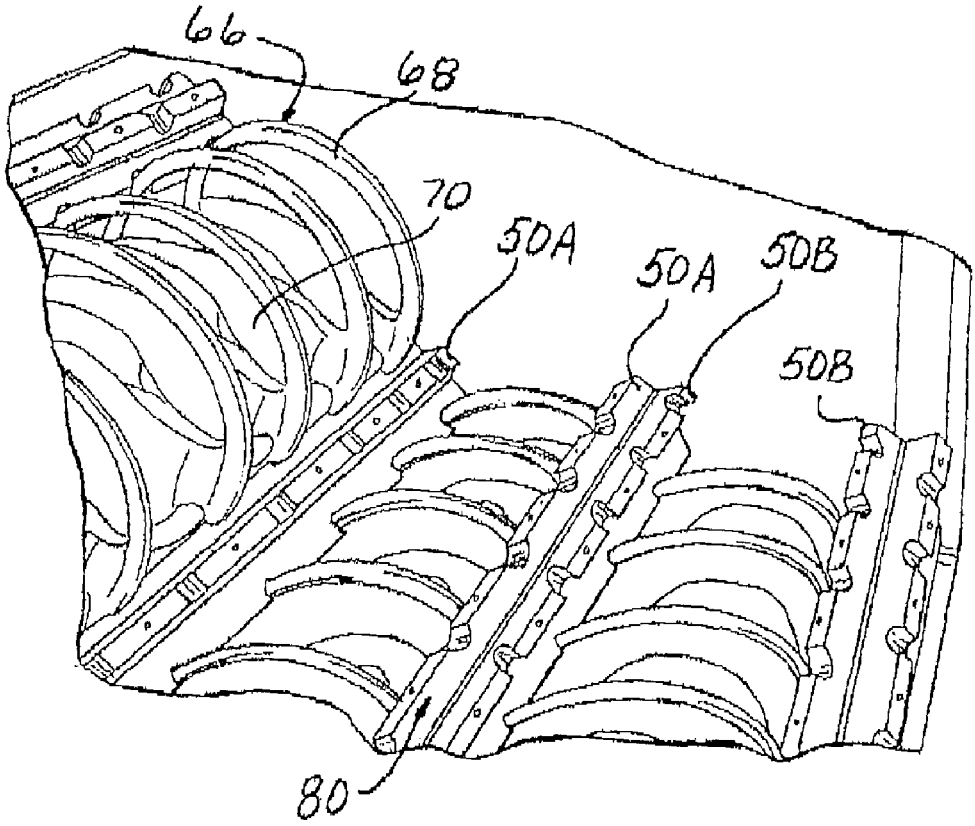
Fig. 4 (Prior Art)
FIG. 4 is a perspective view showing mounting of the second tier of articles on the article support means of the base assembly of the PRIOR ART.

The detailed description below is for preferred embodiments and is intended to explain the current invention. It is to be understood that a variety of other arrangements are also possible without departing from the spirit and scope of the invention.

Referring now to FIGS. 5-10, there is depicted an article support means 100 which is used to form upper rows of article support means above the rows of articles supported on the base 14 as described above relative to PRIOR ART FIGS. 1-4. The article support means 100 is also devised to support the upper rows on the base rows of articles in a free standing manner without engagement or connection to the side walls of the container 12 in which the article support means 100 is disposed. Article support means 100 comprises a first rack 110A and a second rack 110B coupled with one another in a manner consistent with the description provided below.

The term "rack" as used herein, is defined as a slotted form or member and, more specifically, as an expanded thermoplastic, slotted foam member. Such racks are also referred to as dunnage. The "A" and "B" designation for the racks 110A and 110B are to identify the different orientations of the racks 110A and 110B relative to one another when the respective racks 110A and 110B are coupled together. It will be understood that the racks 110A and 110B are identically constructed, with only their mounting orientation differing as described hereafter. Each of the racks 110A and 110B comprising the article support means 100 has a generally elongated shape between an opposed first end 112 and a second end 114.

A plurality of open ended notches denoted generally by reference number 116 are formed at equal spacings between the first and second ends 112 and 114 of each of the racks 110A and 110B. The notches 116, for the specific use in supporting steering wheels, have a generally circular cross-section. Obviously, other shapes for the notches 116 may be employed to support different shaped articles on the racks 110A and 110B.

The article support means 100 includes two pairs of generally co-planar, aligned racks 110A and 110B. Each rack 110A and 110B comprises a first spine 118 and a second spine 120, wherein each spine 118 and 120 has a plurality of notches 116 for receiving the peripheral surface of a plurality of articles. The spines of the respective racks 110A and 110B are denoted as spines 118A and 120A for rack 110A, and spines 118B and 120B for rack 110B, respectively, when specificity requires such a reference. Each one of the racks 110A and 110B also has a plurality of openings 122 formed in the racks 110A and 110B. The respective openings 122 are disposed intermediately to spines 118 and 120. At least one of the racks 110A and 110B has means 124 for separating and coupling the first spine 118 and the second spine 120 so as to mateably form one of the racks 110A and 110B, which is then coupled to one of the remaining racks 110A and 110B to form the article support means 100. The notches 116 in the spines 118 and 120 are offset between two adjacent spines to nest the articles in one spine within the articles in two adjacent spines.

Figure 6:
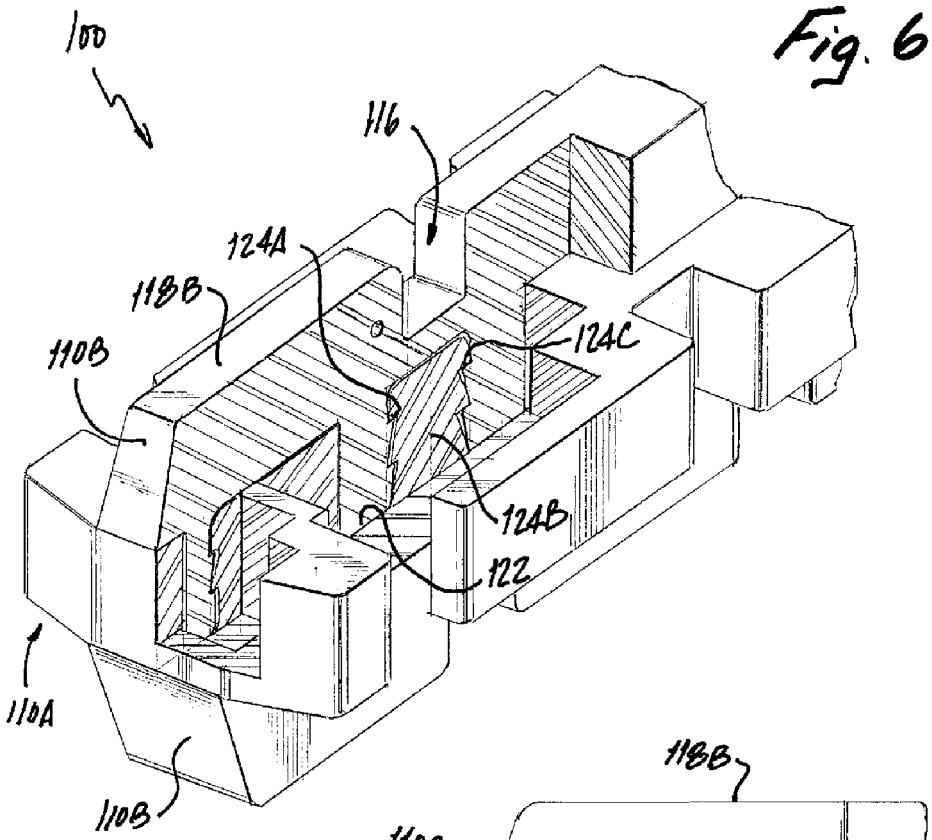
FIG. 6 is a cut-away perspective view of one embodiment of an article support means depicting a rack having spines that are separable about means.
Figure 7:
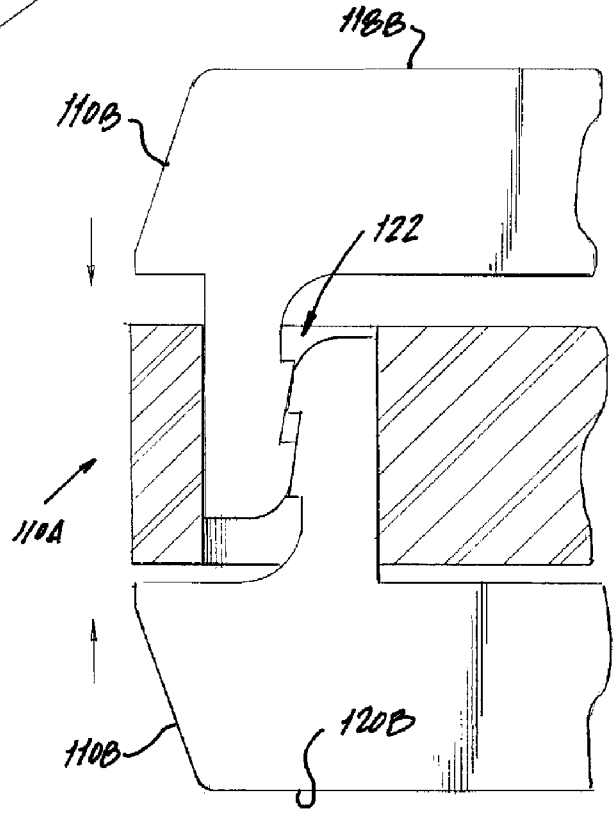
FIG. 7 is an cross-sectional view of an end of the rack separated into respective spines along means, depicting the coupling of the spines.
Figure 8:
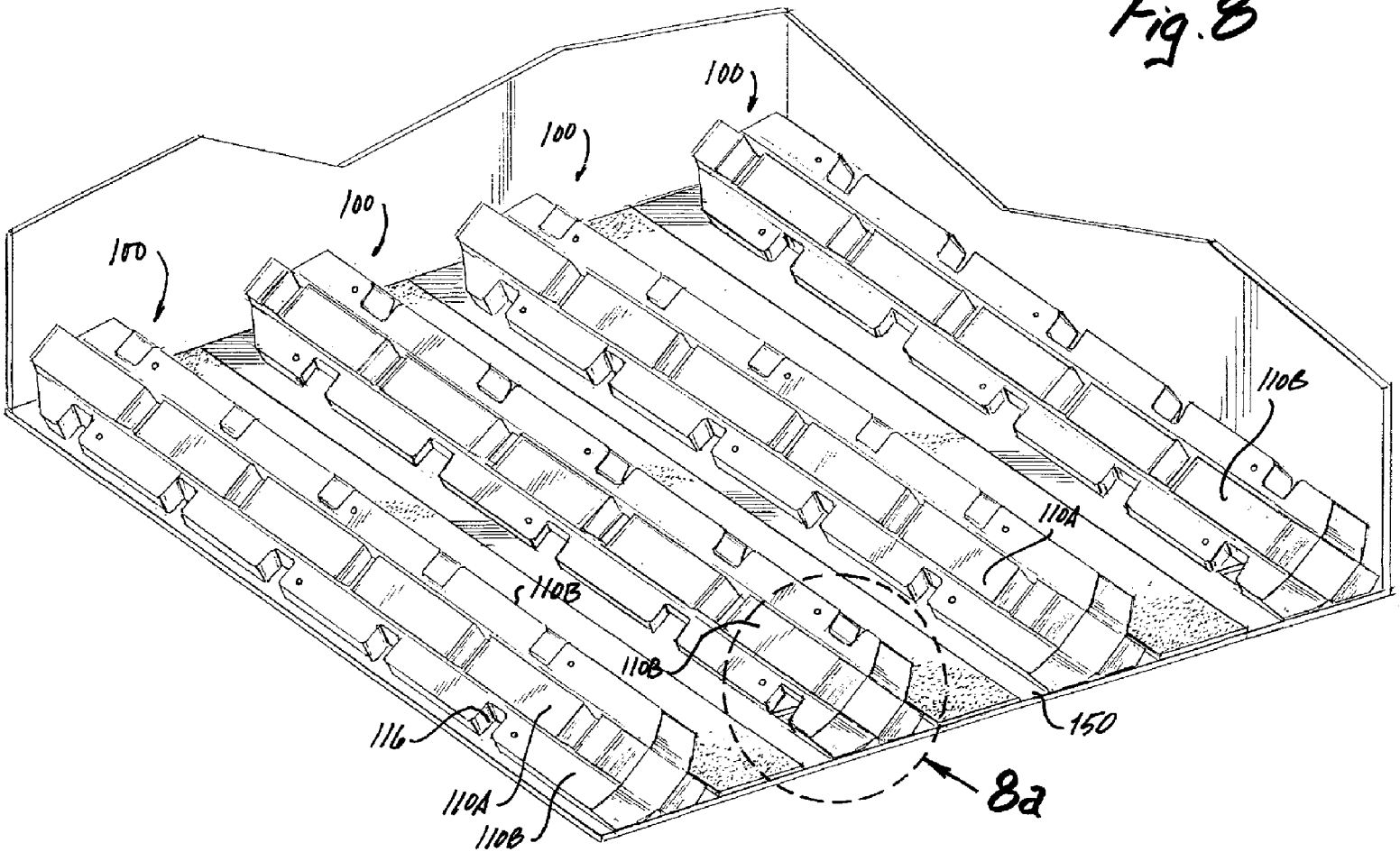
FIG. 8 is a top perspective view of a base having a plurality of article support means consistent with the disclosure of the present invention coupled to the base.
Figure 8A:
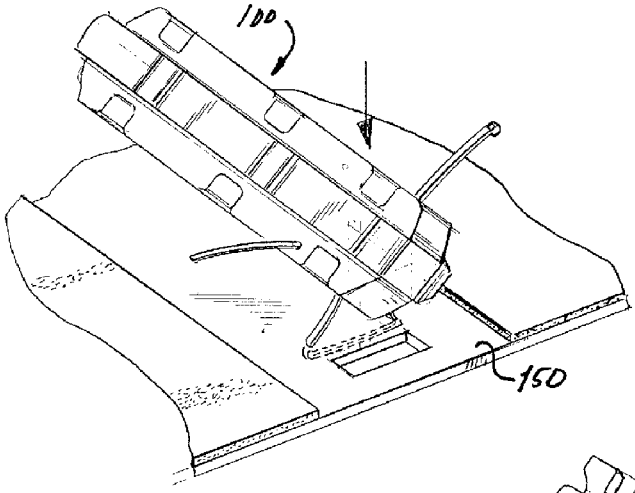
FIG. 8*a* is a top perspective view of a base having a plurality of article support means consistent with the disclosure of the present invention coupled to the base by means of a tie.

Coupling means 124 may comprise a variety of combinations, including the use of a female connector 124A and a male connector 124B, as depicted in FIG. 6. In this embodiment, the openings 122 are dimensioned to receive and accommodate coupling means 124 in a friction fit arrangement. Thus, when the female connectors 124A and male connector 124B are coupled within an opening 122, the dimension of the opening 122 substantially corresponds to the combined dimension of the female connectors 124A and male connector 124B of coupling means 124. The female connectors 124A and male connector 124B may have complementary barbs 124C that allow the female connectors 124A and male connector 124B to fit together like puzzle pieces, and thus form a firm friction fit impingement between them. Other coupling means 124 envisioned include the use of clips, binders and other similar devices.

Figure 5A:
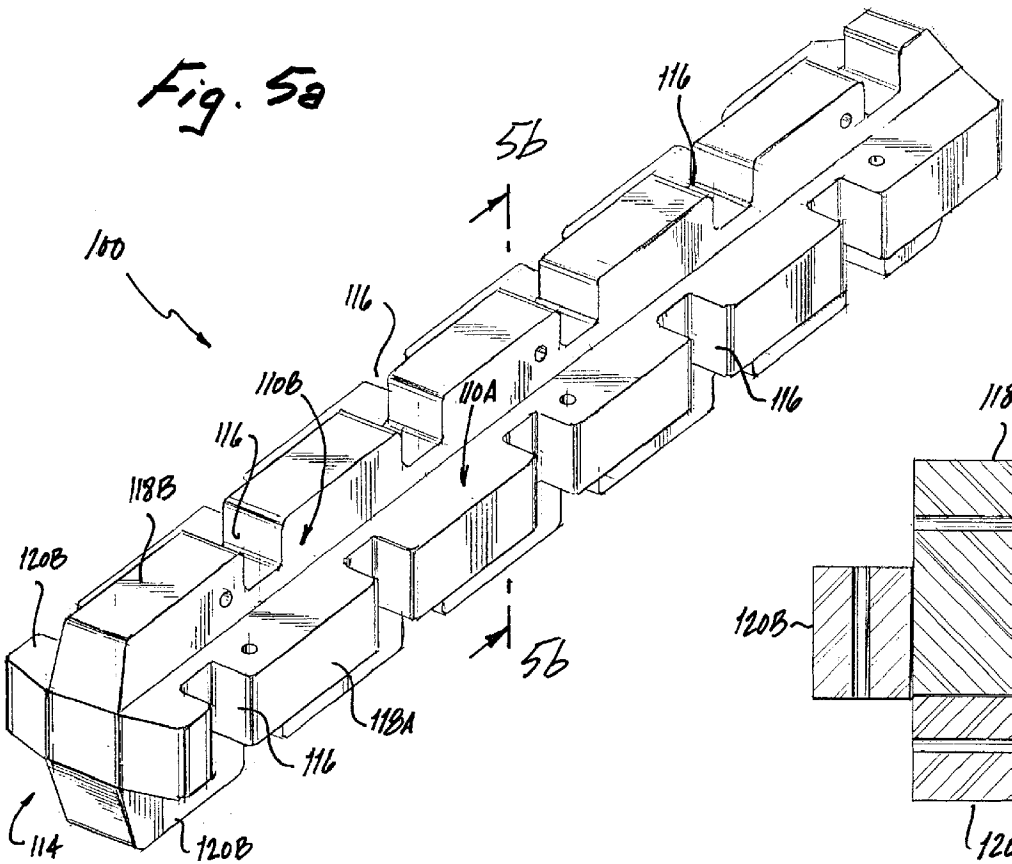
FIG. 5*a* is a perspective view of the present invention depicting an article support means comprising a first rack and a second rack coupled so as to form a four-spined article support means.
Figure 5B:
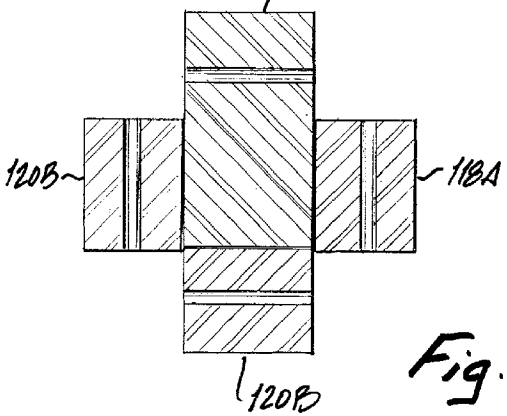
FIG. 5*b* is a top or bottom view of FIG. 5*a;*
Figure 5C:
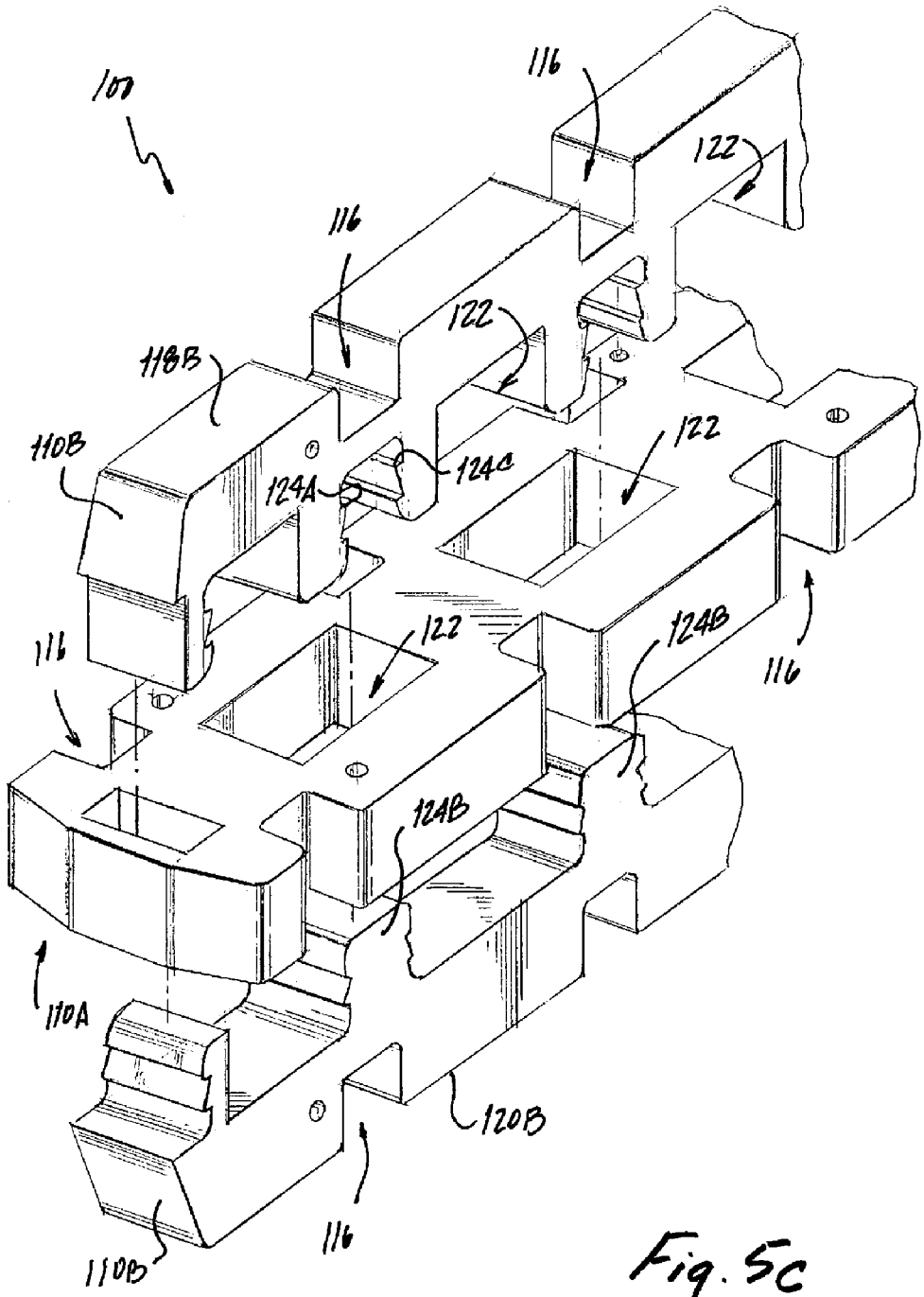
FIG. 5*c* is an exploded view of the assembled article support means

The spines 118A and 120A of rack 110A are oriented approximately 90 degrees from the spines 118B and 120B of rack 110B, thereby forming a four-spined article support means 100. Therefore, and as depicted in FIGS. 5*a* and 5*b*, each spine 118A and 120A, and 118B and 120B, respectively, of racks 110A and 110B is oriented 90 degrees to adjacent spines.

In this orientation, the notches 116 in each spine 118B and 120B of rack 110B are aligned. Similarly, the notches 116 in each spine 118A and 120A of rack 110A are aligned. However, the aligned pairs of notches 116 in the respective spines 118A and 118B, and 120A and 120B, of racks 110A and 110B, are longitudinally offset along the length of the spines. Thus, adjacent spines possess longitudinally offset notches 116. This enables a plurality of article support members 100 to be mounted on the rows of steering wheels 66 supported on the base 14, as shown in FIG. 10 with the notches 116 in the racks 110A and 110B of the article support means 100 positioned to engage alternating steering wheels 66 into two adjacent rows of steering wheels 66.

Figure 10:
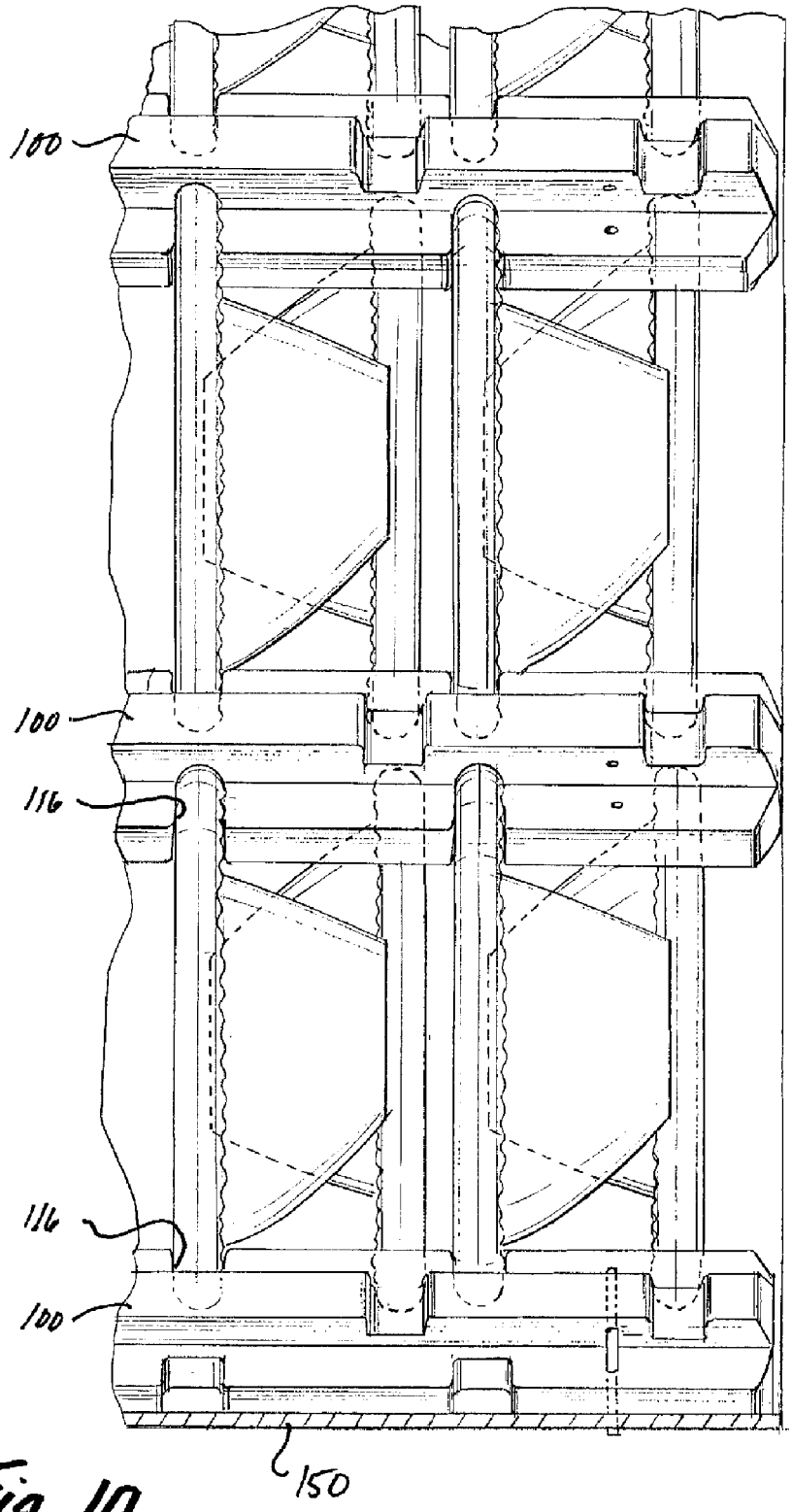
FIG. 10 is a top-down perspective view of the base assembly showing the two dimensional horizontal nesting of the steering wheels in multiple rows and tiers on the article support means with the phantom lines indicating a vertically superior layer to the articles nested on the base.

As shown in FIG. 10, the pair of article support means 100 which are disposed ninety degrees longitudinally with respect to each other are arranged relative to each other in two adjacent rows, including the center row and one outer row of steering wheel 66 mounted on the base 150, such that the notches in one rack 110A of the article support means 100 engage the steering wheel 66 in the center row: while the notches in the immediately adjacent rack 110B on the under side of the article support means 100, engage the steering wheel 66 in the immediately adjacent outer row. Similarly, the outermost article support means 100 is oriented such that the notches in one rack 110B engage the steering wheel 66 in the outer row of steering wheels 66. The other pair of article support means are similarly arranged for engaging nested steering wheels 66 in the center row and the other outer row of steering wheel 66. The perspective view of the apparatus as viewed from above depicts the steering wheels 66 arranged in alternating directions between levels to maximize packing with the top layer depicted in phantom lines over the bottom layer.

For purposes of the following description, the endmost notch adjacent the first end 112 of each of the racks 110A and 110B will be denoted by reference number 116A. The first notch adjacent to the second end 114 of each of the racks 110A and 110B will be denoted by reference number 116B. The notch 116A is spaced closer to the first end 112 of each rack 110A and 110B than the notch 116B is spaced from the second end 114 of each of the racks 110A and 110B. This provides nesting of the articles within the container 12 as described hereafter.

This arrangement places alternating racks 110A and 110B in an upward facing, generally angular position for mounting steering wheels 66 in a row above the steering wheels 66 mounted on the base 150. This mounting arrangement also provides for vertical nesting of steering wheels 66 between two vertically adjacent rows of steering wheel 66. Since like arranged racks 110A are disposed uppermost in the pair of article support members 110 above the steering wheels 66 mounted on the base 150, a steering wheel 66 may be mounted into the notches 116A at the first end 112 of the racks 110B. The bottom portion of the rim 66 of the steering wheel mounted in the notches 116 in the racks 110B is nested between adjacent rims 68 of steering wheels 66 in the bottom row of steering wheels 66. This applies equally to all of the other steering wheels 66 mounted in the racks 110B on the outermost row of steering wheels 66.

At the same time, the orientation of the article support means 100 places the notches 116B in the adjacent racks 110A farther away from the side wall of the container 12, so as to be able to receive the rim 68 of a steering wheel 66 in a position to enable the rim 68 to nest between two adjacent steering wheels 66 in the bottom center row of steering wheels 66. The arrangement of notches in the other outer row of steering wheels 66 above the outer base row of steering wheel 66 is the same as the opposed outer row described above.

This two-way or two dimensional nesting of the steering wheels 66 includes both horizontal nesting between side-by-side disposed rows of steering wheels 66 and vertical nesting between two vertically disposed rows of steering wheels 66.

Preferably, each of the racks 110A and 110B are formed of a material which provides a non-scratch, non-marring surface for use with articles having a Class A exterior surface, such as steering wheels, etc. The racks 110A and 110B may also be formed of a material which resists dirt and other debris so as to provide a durable, long term use life. By example only, each of the racks 110A and 110B is formed of a cross-linked polyethylene foam. This material is easily fabricated into the illustrated shape of each rack 110A and 110B. The notches 116 may also be machined into the respective spines 118 and 120 of each rack 110A and 110B. Other materials may also be employed to form each of the racks 110A and 110B, such as polyvinyl nitryl foam, polyvinylchloride foam, rubber foam, and ethyl vinyl actate (EVA) foam.

Figure 9:
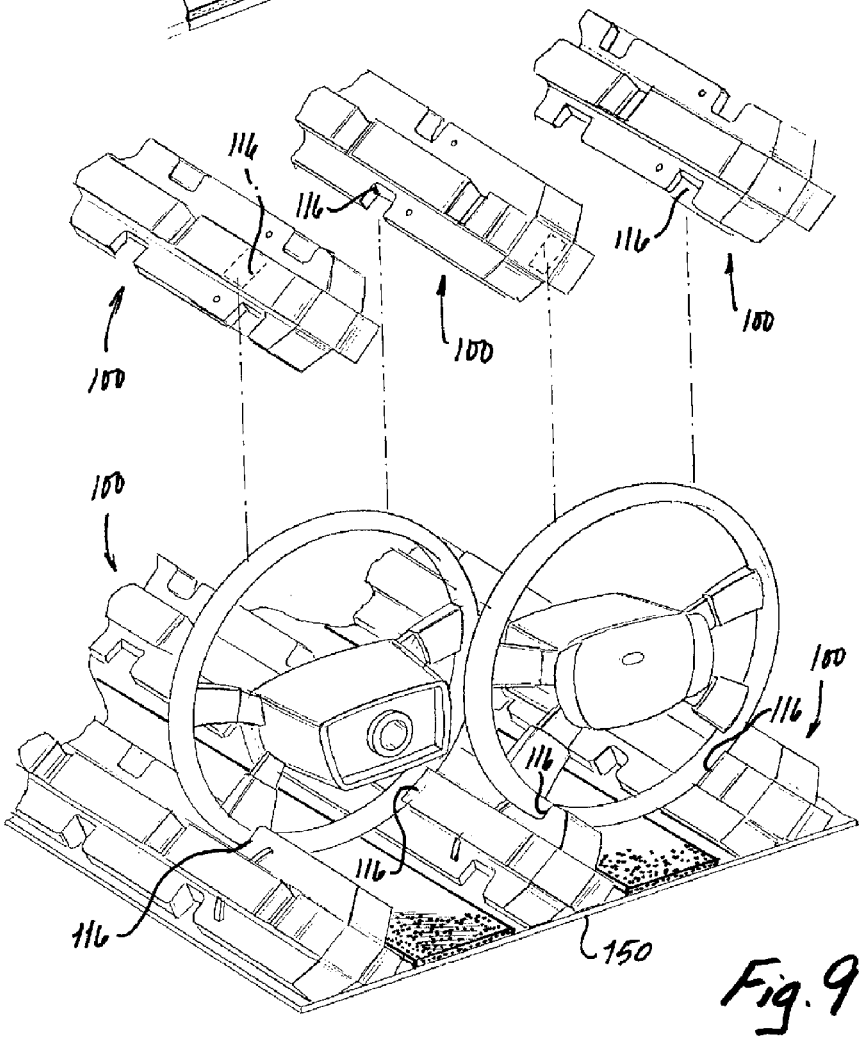
FIG. 9 is a perspective view showing the two dimensional horizontal nesting of the steering wheels in multiple rows and tiers on the article support means of the base assembly.

In another embodiment, such as depicted in FIG. 9, the apparatus for storing a plurality of articles comprises a plurality of article support means having a first rack and a second rack, having the corresponding spines, notches, openings and means consistent with the disclosure of the other embodiments presented above. In this embodiment, the apparatus may further comprise a base 150 having a plurality of article support means 100 coupled thereto. The article support means 100 may be coupled to the base 150 via adhesive, mechanical fasteners, ties or other similar means known to those skilled in the art. In the embodiment that incorporates coupling the article support means 100 to the base 150 via ties or similar fasteners, the racks 110A and 110B possess rack fastener channels 130 and the base possess base fastener channels 131 through which the tie or similar fastener passes. The base 150 may be fabricated from a variety of materials, including a number of polymeric material, including plastic (waferred), foam or other similar material. The base 150, with the article support means coupled thereto, may be placed inside an orthogonally shaped container (of the type described in the PRIOR ART or of a similar nature) so as to form the base of the container. From there, the container may be filled with articles and corresponding article support means in a manner presented above, and in the prior art, for housing and transporting the articles to a destination.

What is claimed is:

1. An apparatus for storing a plurality of articles comprising: a plurality of individual article support means for supporting a plurality of articles in a plurality of longitudinally extending rows, wherein the article support means are disposed within a container, the plurality of articles in the plurality of longitudinally extending rows are supported independent of the side walls of the container, wherein each one of the article support means comprises a first rack and a second rack, each rack possessing a first spine and a second spine, wherein each spine has a plurality of notches for receiving the peripheral surfaces of a plurality of articles; a plurality of openings formed in each one of the racks disposed intermediately to the lateral surface of each spine wherein the openings of a respective rack are spaced longitudinally from each other along the respective rack; and at least one of the racks having means for coupling its respective first spine and its respective second spine so as to form one of the racks for coupling to the other rack through one of the openings.

2. The apparatus of claim 1, wherein the racks are coupled so that each spine of one of the racks is oriented approximately ninety degrees to the adjacent spines of the other rack.

3. The apparatus of claim 1, wherein the notches in the article support means are offset between two adjacent article support means to nest the articles in one article support means within the articles in two adjacent article support means.

4. The apparatus of claim 1, wherein the openings are dimensioned to receive and accommodate coupling means in a friction fit arrangement.

5. The apparatus of claim 4, wherein the coupling means comprises male and female connectors.

6. An apparatus for storing a plurality of articles, each article having a peripheral surface, the apparatus disposed in a container having side walls and a base, wherein the apparatus comprises a plurality of article support means for supporting a plurality of articles, wherein each one of the article support means comprises a first rack and a second rack, and wherein each one of the racks comprises a first spine and second spine, wherein each spine has a plurality of notches for receiving the peripheral surfaces of a plurality of articles; a plurality of openings formed in each one of the racks disposed intermediately to the lateral surface of each spine wherein the openings of a respective rack are spaced longitudinally from each other along the respective rack; and, at least one of the racks having means for coupling its respective first spine and its respective second spine so as to form one of the racks for coupling to another rack.

7. The apparatus of claim 6 further comprising a base having a plurality of article support means coupled thereto.

8. The apparatus of claim 7, wherein the article support means are coupled to the base via adhesive.

9. The apparatus of claim 7, wherein the article support means are coupled to the base via fasteners.

10. The apparatus of claim 9, wherein said article support means coupled to the base possess rack fastener channels.

11. The apparatus of claim 10, wherein said base possesses base fastener channels.

12. The apparatus of claim 11, wherein said article support means are tied to said base by connectedly passing a tie through said rack fastener channels and said base fastener channels.

13. The apparatus of claim 12, wherein the coupling means comprises male and female connectors.

14. The apparatus of claim 6, wherein the racks are coupled so that each spine of one of the racks is oriented approximately ninety degrees to the adjacent spines of the other rack.

15. The apparatus of claim 6, wherein the notches in the article support means are offset between two adjacent article support means to nest the articles in one article support means within the articles in two adjacent article support means.

16. The apparatus of claim 6, wherein the openings are dimensioned to receive and accommodate coupling means in a friction fit arrangement.

17. An apparatus for storing a plurality of articles, each article having a peripheral surfaces, the apparatus being in a container having side walls and a base, the apparatus comprising a plurality of base article support means attached to the side walls and base for forming a series of base article support means in the bottom of the container, wherein the improvement comprises a plurality of individual article support means for supporting a plurality of articles in a plurality of longitudinally extending rows independent of the side walls of the container, wherein each one of the article support means comprises a first rack and a second rack, and wherein each one of the racks comprises a first spine and a second spine, wherein each spine has a plurality of notches for receiving the peripheral surfaces of a plurality of articles; a plurality of openings formed in each one of the racks disposed intermediately to the lateral surface of each spine wherein the openings of a respective rack are spaced longitudinally from each other along the respective rack; and, at least one of the racks having means for coupling its respective first spine and its respective second spine so as to form one of the racks for coupling to the other rack through one of the openings.

18. The apparatus of claim 17 wherein the racks are coupled so that each spine of one of the racks is oriented approximately ninety degrees to the adjacent spines of the other rack.

19. The apparatus of claim 17, wherein the notches in the article support means are offset between two adjacent article support means to nest the articles in one article support means within the articles in two adjacent article support means.

20. The apparatus of claim 17, wherein the openings are dimensioned to receive and accommodate coupling means in a friction fit arrangement.

21. The apparatus of claim 17, wherein the coupling means comprises male and female connectors.

22. The apparatus of claim 17, wherein the article support means are coupled to the base via adhesive.

23. The apparatus of claim 17, wherein the article support means are coupled to the base via fasteners.

24. The apparatus of claim 23, wherein said article support means coupled to said base possess rack fastener channels.

25. The apparatus of claim 23, wherein said base possesses base fastener channels.

26. The apparatus of claim 25 wherein said article support means coupled to said base possess rack fastener channels, said article support means are fastened to said base by connectedly passing a fastener through said rack fastener channels and said base fastener channels.

27. The apparatus of claim 23, wherein said fasteners are ties.

* * * * *